United States Patent [19]

Otema

[11] Patent Number: 4,560,214

[45] Date of Patent: Dec. 24, 1985

[54] SHOW CASE

[76] Inventor: Martin Otema, 51 Pine Ridge Dr., Scarborough, Ontario, Canada, M1M 2X6

[21] Appl. No.: 557,516

[22] Filed: Dec. 2, 1983

[51] Int. Cl.[4] ..... A47F 3/12

[52] U.S. Cl. ..... 312/114; 312/138 R; 312/290

[58] Field of Search ..... 312/114, 138, 290, 293, 312/117, 119, 257 R, 252 N; 52/27, 56, 474, 475, 208; 49/61, 67

[56] References Cited

U.S. PATENT DOCUMENTS

| | | | |
|---|---|---|---|
| 2,001,106 | 5/1935 | Mullen | 312/138 R |
| 2,263,837 | 11/1941 | Erickson | 108/96 |
| 2,330,044 | 9/1943 | Gaston | 312/293 |
| 3,714,751 | 2/1973 | Lackey | 52/208 |
| 4,381,876 | 5/1983 | Fenwick | 312/114 |

FOREIGN PATENT DOCUMENTS

| | | | |
|---|---|---|---|
| 312625 | 4/1956 | Switzerland | 312/114 |

*Primary Examiner*—William E. Lyddane
*Assistant Examiner*—Joseph Falk
*Attorney, Agent, or Firm*—Rogers, Bereskin & Parr

[57] ABSTRACT

A merchandise show case convertible between different display configurations. The case includes a carcass structure having a base and end walls or gables extending upwardly from the base. Top and front panels, e.g. glass panels are supported on top and front edges of the end walls for defining a display space. The panels are held in place by an external rectangular frame which traps the edges of the panels against the edges of the end walls. In one embodiment, the frame includes top and bottom cross members. The bottom cross member is hinged to the base of the show case and the top cross member can be releasably secured at the back so that, when released, the frame can be tipped forward to allow the panels to be easily removed and/or changed.

16 Claims, 17 Drawing Figures

FIG. 1
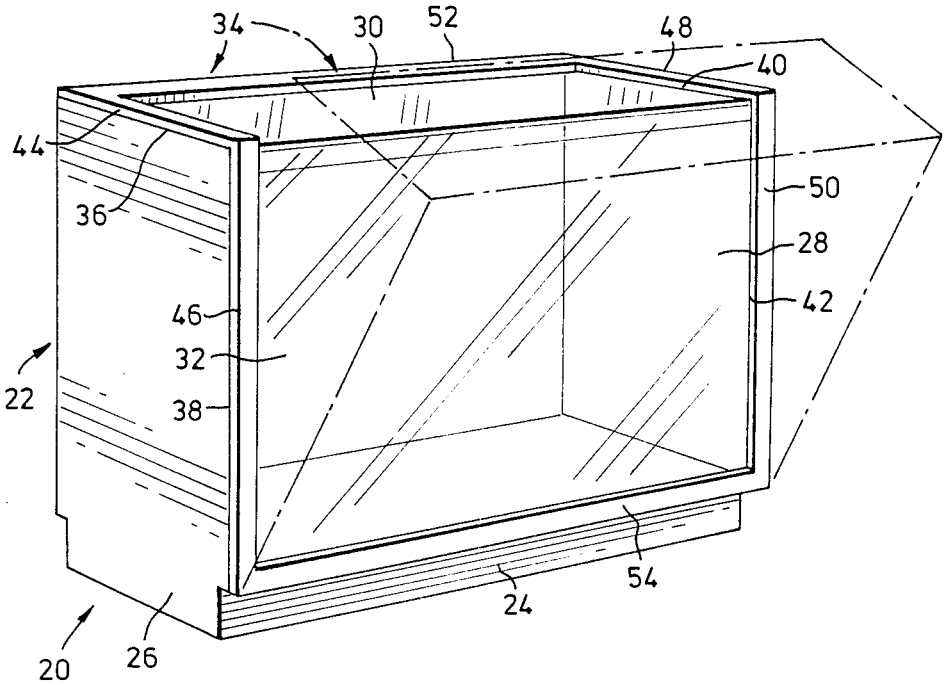
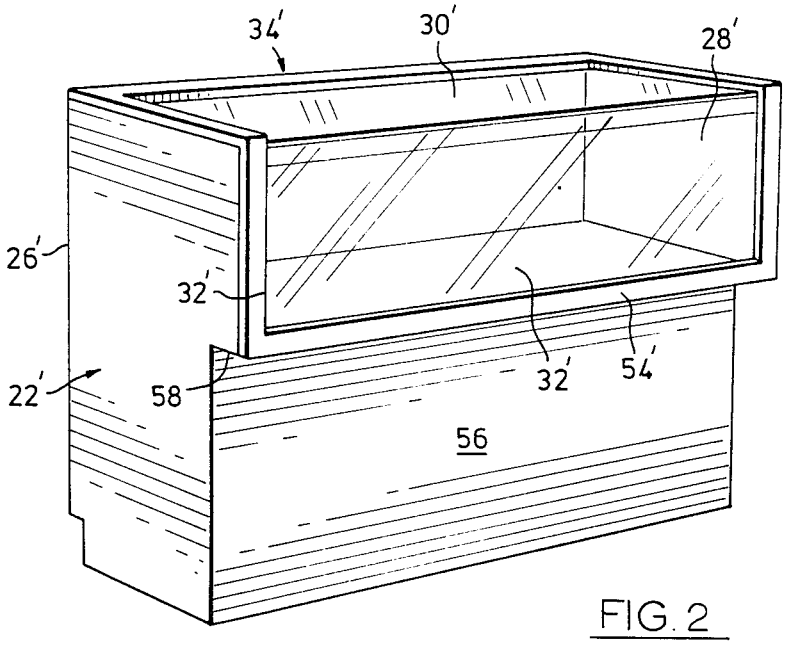
FIG. 2

FIG. 4
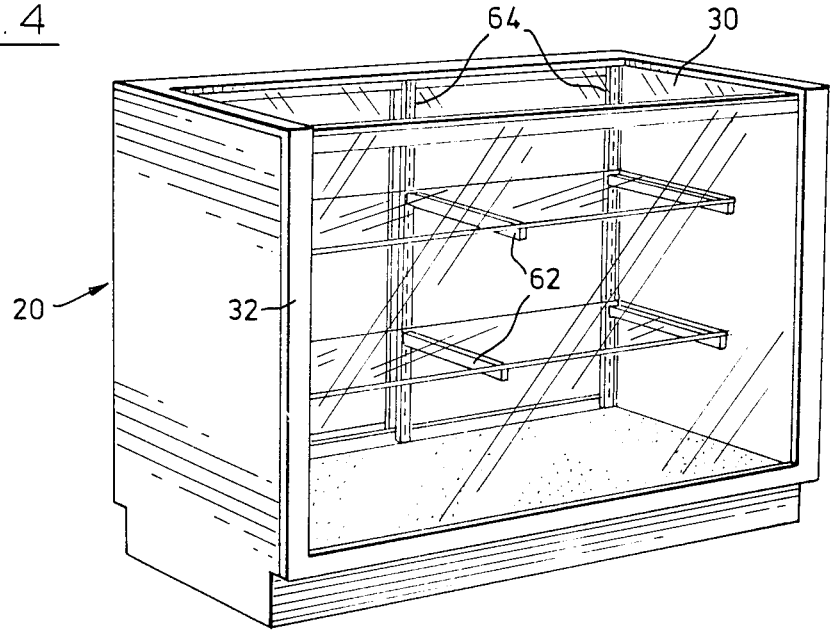
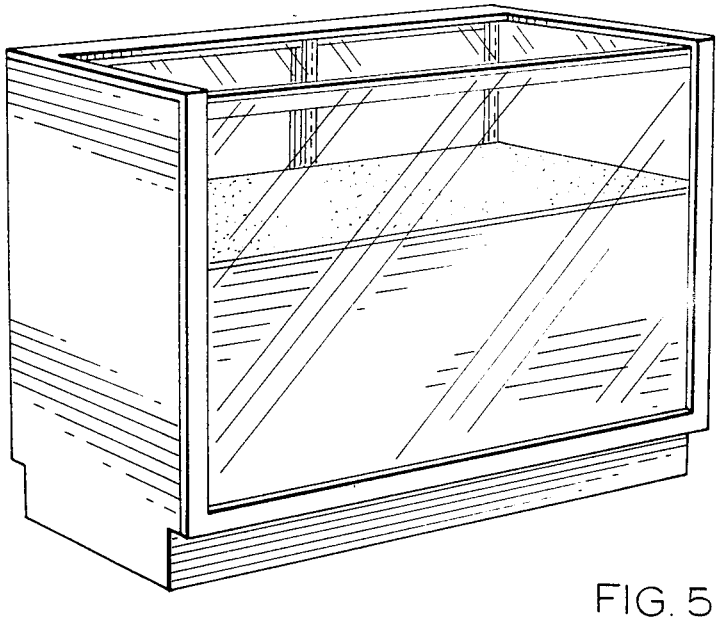
FIG. 5

FIG. 14
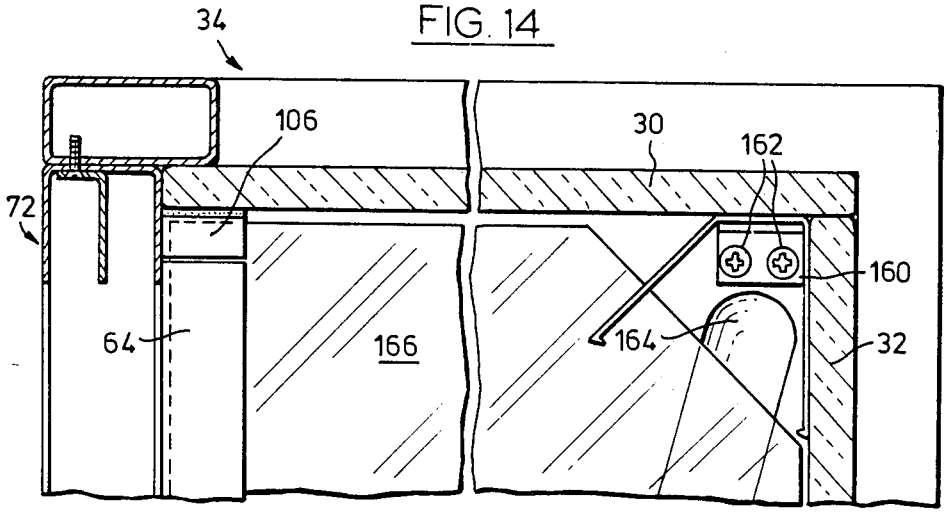
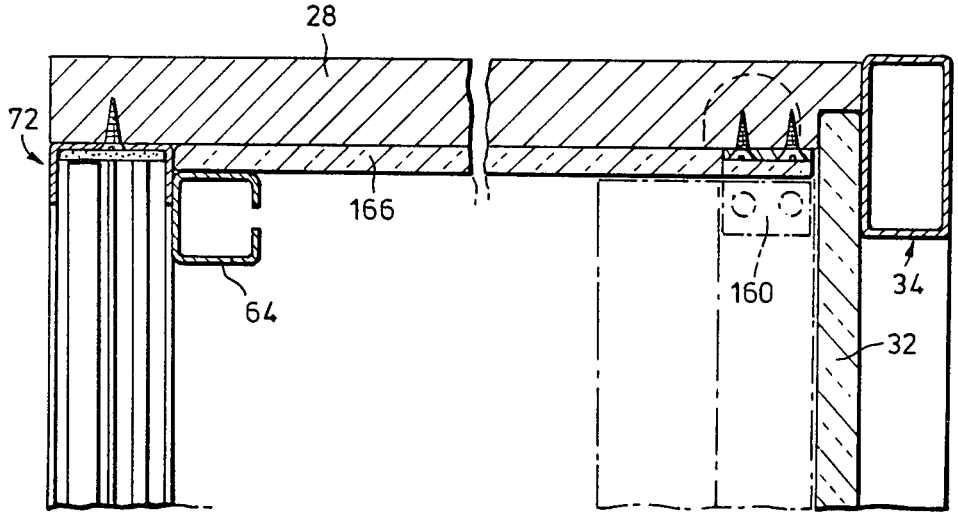
FIG. 15

SHOW CASE

This invention relates to show cases used to display merchandise, for example, in stores and at exhibitions.

Many different types and styles of show case are currently available. A typical example of a show case as might be used, say, in a jewellery store will be of generally rectangular box shape having transparent glass panels at the top and front to permit viewing of merchandise within the case. Internally, the case may have shelves or a box-shaped structure known as a "bunk" on which the merchandise is placed. Lockable sliding doors at the back of the case provide access to the merchandise for store personnel only.

In a jewellery store, security of the merchandise is a prime consideration. In other environments, however, a show case may be designed as what is known as a "self selector;" that is, a show case having open shelves from which a customer can select merchandise without the assistance of store personnel. This type of show case would, of course, have no glass panels, at least at the front.

While designs may vary from show case to show case, generally any one show case will be of a fixed design and will not be convertible to a different function. Typically, the show case will comprise a rigid "carcass" or framework to which various components such as, light rails, glass panels, etc. are fixed. A show case for a jewellery store, for example, will have glass panels glued or otherwise permanently affixed to the carcass. While this design achieves the objective of security in the sense that unauthorized removal of merchandise can be effected only by breaking the glass, conversely, the glass cannot readily be replaced when it becomes scratched, which often happens in a jewellery store environment.

An object of the present invention is to provide an improved show case structure which is convertible to different styles, but which at the same time can be built to meet customer requirements with respect to security.

The show case provided by the invention has a carcass structure which includes a base and end walls extending generally vertically upwards from the base and defining with the base a space for receiving merchandise to be displayed. The end walls have respective top and front edges against which can be positioned top and front panels extending between the end walls, for enclosing merchandise in the said space. The case also includes frame means having frame members arranged to overlie the edges of the end walls and trap against the edges intervening portions of the panels so that the panels are held in place on the carcass structure by the frame members. The frame means is removably secured to the carcass structure, permitting ready removal and/or replacement of the panels.

A primary advantage of the show case provided by the invention is that the panels (e.g. glass panels) are not permanently fixed to the carcass structure of the show case but are merely trapped or sandwiched between the carcass structure and the frame means. This allows the panels to be readily removed and/or replaced simply by first removing the frame means. In this way, not only can the panels be readily replaced when they become damaged or when the show case is to be refurbished but the show case can be readily converted for different uses. For example, by totally removing the panels, the show case becomes a self selector. Alternatively, different types of panels can be used where the show case is required to perform different functions. Glass panels would be appropriate where the show case is to be used in a jewellery or department store, but in other environments, one or both of the panels might, for example, be replaced by a plastic laminate, a wooden panel or a suede covered panel.

The frame means preferably takes the form of a unitary frame comprising the four frame members required to overlie the top and front edges of the two end walls, and top and bottom cross frame members. In this case, the frame is preferably secured to the carcass structure at the top and bottom cross members. The bottom cross member may be hinged to the carcass structure below the front panel and the top frame member secured to the carcass structure rearwardly of the top panel, for example, by screws extending upwardly through a cross member of the carcass structure rearwardly of the top panel and into the top cross member of the frame. Generally, two screws will be sufficient, one at each side, and will be arranged so that they can readily be removed in a short time by using a screw driver. The whole frame can then be tilted forward about the hinges on the bottom cross member of the frame to provide access to the panels.

Where a unitary frame is employed, it can of course be decoratively finished to enhance the aesthetic appeal of the show case.

In order that the invention may be more clearly understood, reference will now be made to the accompanying drawings which illustrate a number of preferred embodiments of the invention by way of example, and in which:

FIGS. 1, 2 and 3 are front perspective views showing three different styles of show case which may be constructed in accordance with the invention;

FIGS. 4 and 5 are front perspective views of the show case shown in FIG. 1 and illustrate the show case as converted to two different internal merchandise display configurations;

FIGS. 12 to 16 are detail sectional views illustrating various features of the show case; and, FIG. 17 is a front perspective view showing a further alternative style of show case.

Figure 3:
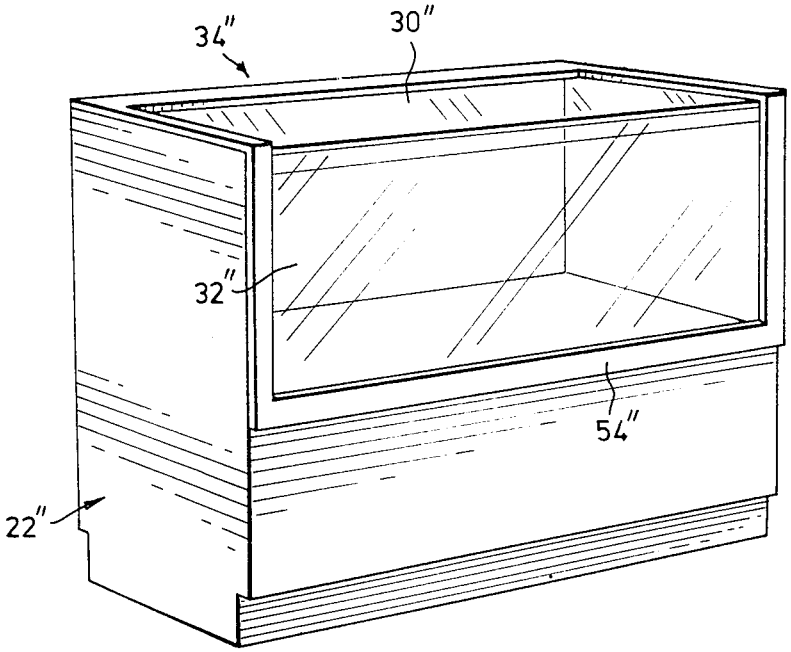

Referring first to FIG. 1, the show case is generally denoted by reference numeral 20 and includes a carcass structure 22 having a base 24 and end walls 26 and 28 (usually called "gables") which extend upwardly from the base generally vertically and define with the base a space for receiving merchadise. In this case, the internal space is shown empty and the show case might indeed be used in this configuration, for example, for displaying large items. Alternative display configurations are shown in later figures.

The end walls 26 and 28 have top and front edges against which respective top and front panels 30 and 32 are shown positioned and against which they are held by a unitary frame 34 as will be described in more detail later. The top and front edges of the respective end walls are not visible as such in FIG. 1 but are indicated by reference numerals 36 and 38 in the case of panel 26 and 40 and 42 in the case of panel 28.

Frame 34 is made in one piece and includes frame members which overlie the top and front edges of the panels 26 and 28, and which are denoted respectively 44, 46, and 48, 50, and top and bottom cross members 52 and 54 which extend transversely between those members and result in the frame defining a closed geometric figure.

As will be described in more detail later, frame 34 is hinged to the carcass structure 22 at the bottom frame member 54 and is releasably secured to the structure at member 52 so that, when the frame has been released, it can be tilted forwardly about its hinges generally as indicated in ghost outline in FIG. 1. The panels 30 and 32 are then exposed for removal or replacement as required without the need to dismantle the show case as a whole. When the frame is in the position shown in full lines in FIG. 1, the panels 30 and 32 are trapped or sandwiched between the frame and the the carcass structure and are held firmly in place while maintaining the security of the show case.

In this embodiment, the show case is shown fitted with glass panels 30 and 32 but as indicated previously, other forms of panel can of course be used, or one or both of the panels could be removed entirely. The carcass structure 22 is of wooden construction and will be provided with appropriate surface finishing. Frame 34 is of welded steel construction and is chromium plated for decorative effect. Alternatively, other materials such as brass or hard wood can be used.

FIG. 2 shows an alternative design and primed reference numerals have been used in that view to denote parts which correspond with parts shown in FIG. 1. Thus, in the case of FIG. 2, the carcass structure 22′ is designed so that the front edges of the end walls 26′ and 28′ extend down over only approximately half of the height of the front of the show case as a whole. The front glass panel 32′ is then correspondingly sized, as is the frame 34′. Below the front panel, the carcass structure 22′ presents a plain opaque panel 56 below the display area of the show case. Panel 56 is inset from the glass panel 32′ and the frame 34′ by virtue of a step 58 between panel 56 and the bottom frame member 54′. This gives the top portion of the show case in the area of panel 32′, a somewhat forwardly protuberant appearance as compared with the generally flat front of FIG. 1.

In FIG. 3, on the other hand, the front of the show case is gerally flat and the step 58 of FIG. 2 is omitted but the front glass panel extends only part way down the height of the show case. Double primed reference numerals have been used in FIG. 3 to denote parts corresponding with the parts shown in FIG. 1. In this case, the front panel 32″ is of a height between the heights of the two panels shown in the previous views and frame 34″ is also correspondingly sized.

Apart from these design differences, the three show cases shown in FIGS. 1 to 3 are constructionally very similar and may be converted to different styles and to different internal show case configurations in generally the same fashion. In all cases, the bottom frame member 54, 54′ or 54″ is hinged to the carcass structure of the show case so that the frame can be tilted forwardly for removal of the top and front panels.

FIGS. 4 to 7 show the case of FIG. 1 converted to provide respectively different internal show case configurations. These views show primarily visual features of the show case but constructional details are shown in later views and are described below.

Briefly, FIG. 4 shows the show case 20 of FIG. 1 fitted with internal shelves 60 supported by brackets 62 from vertical standards 64 at the rear of the show case. The glass panels 30 and 32 are shown in place but could of course be removed for a self selector show case.

In FIG. 5, on other hand, the shelves 60 have been replaced by a rectangular box or bunk 66 to provide a still further different display configuration. The bunk will normally have suitably decoratively covered surfaces (e.g. plastic laminate, mirror or fabric surfaces) and will provide a single elevated display surface within the show case. Bunk 66 could be formed by a box-like structure inserted into the show case from the front after hinging down the frame 34 and removing the front panel 32. Preferably, however, the bunk is formed by a top horizontal shelf panel 68 and a front panel 70 supported from the standards 64 as best shown in FIG. 6.

Figure 6:
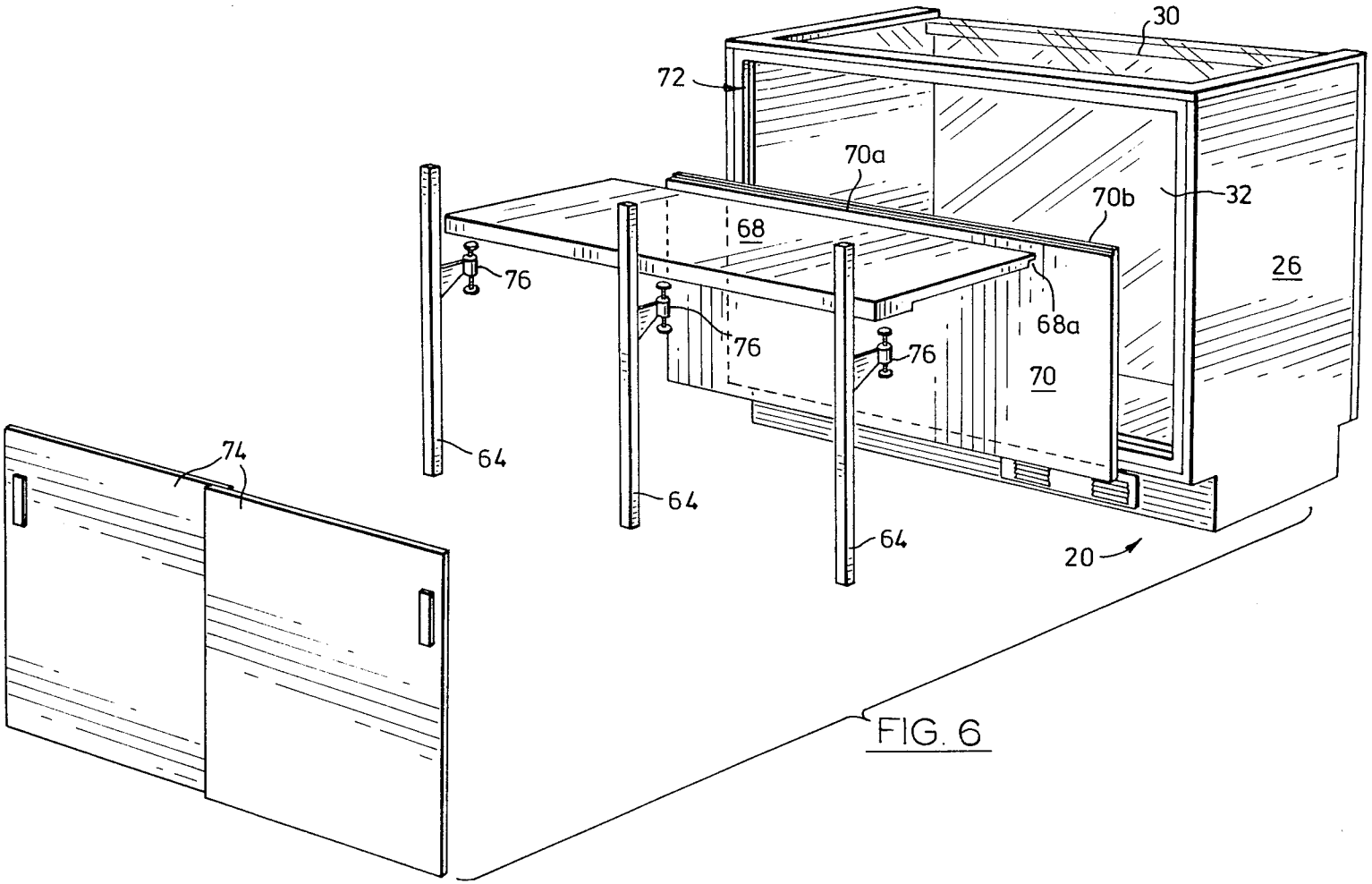
FIGS. 6 and 7 are partly exploded perspective views from the rear of the show case shown in FIG. 5 illustrating two different forms of internal structure which may be employed to achieve generally the display configuration of FIG. 5.
Figure 10:
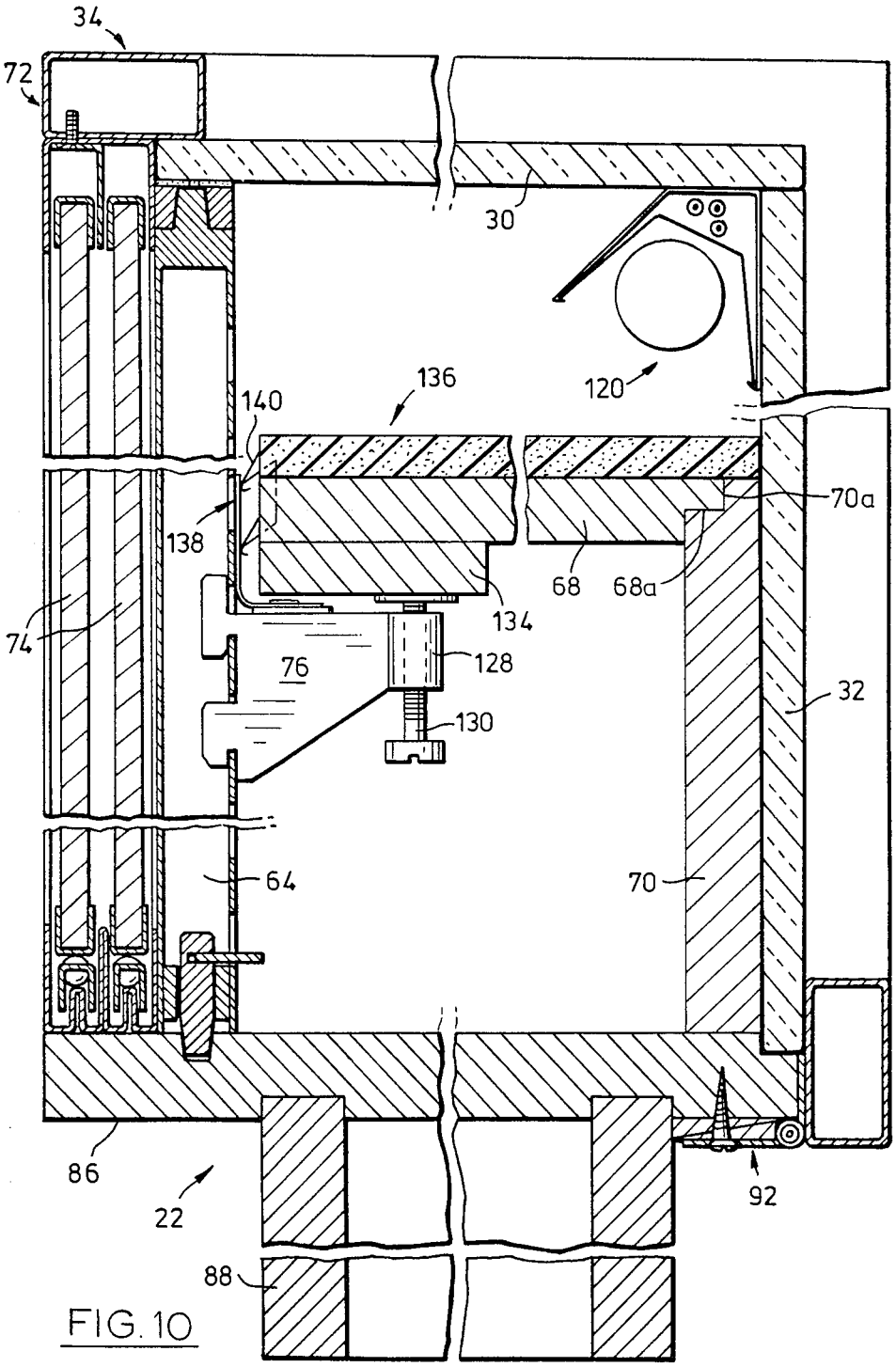
FIG. 10 is a view similar to FIG. 9 but showing the internal display configuration of FIGS. 5 and 6.

FIG. 6 shows the show case 20 from the rear and illustrates the fact that the back of the show case is defined by a rectangular frame 72 secured to the carcass structure as will be described later and defining a generally open space at the back of the show case. When the show case is assembled, sliding doors shown in exploded positions at 74 are fitted to the frame as will be described. With these doors removed, the bunk 66 is inserted from the rear of the show case and the doors are then replaced. As shown, the two panels 68 and 70 fit together at right angles to one another with a rebate 68′ along the front edge of panel 68 receiving a tongue 70*b* formed by a similar rebate 70*a* along the top edge of panel 70. In the assembled show case, the panel 70 simply rests against the inner surface of the front glass panel 32 and is held against that panel at its top edge by panel 68. Panel 68 is in turn supported adjacent its rear edge by adjustable brackets 76 on the standards 64. Constructional details of FIG. 6 are shown in FIG. 10 which will be described later.

Figure 7:
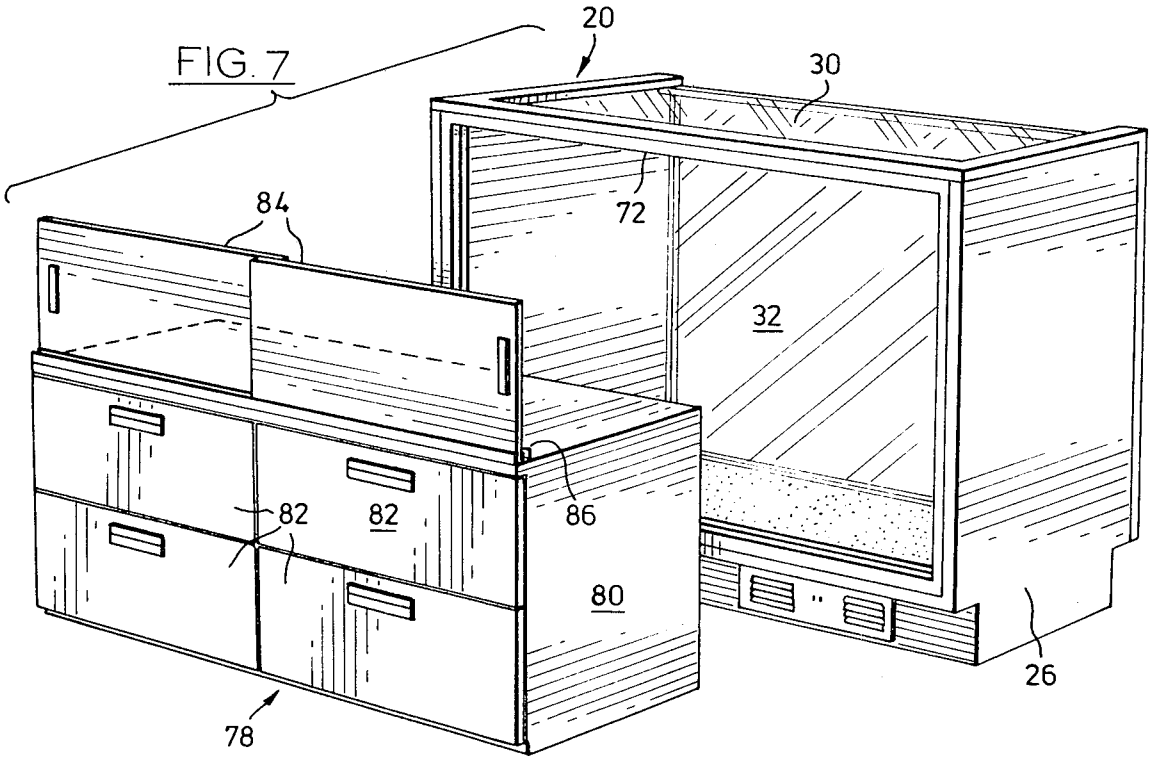

FIG. 7 shows a further alternative form of "bunk" structure which would result in the show case having a frontal appearance similar to FIG. 5 but with drawers at the back of the show case. In this case, the doors 74 and standards 64 of FIG. 6 have been removed so that the back of the show case is completely open within frame 72. A separate drawer assembly 78 is provided and comprises a box-shaped enclosure 80 fitted with four drawers 82 at the rear of the assembly (the front as drawn as in FIG. 7) and with a plain front panel (not visible) which will appear behind the glass panel 32 of the show case generally as seen in FIG. 5. At the top of assembly 78 are a pair of sliding doors 84 received in tracks 86 secured to the top of enclosure 80. Top edges of the doors slide in corresponding tracks incorporated in frame 72 as will be described.

Figure 8:
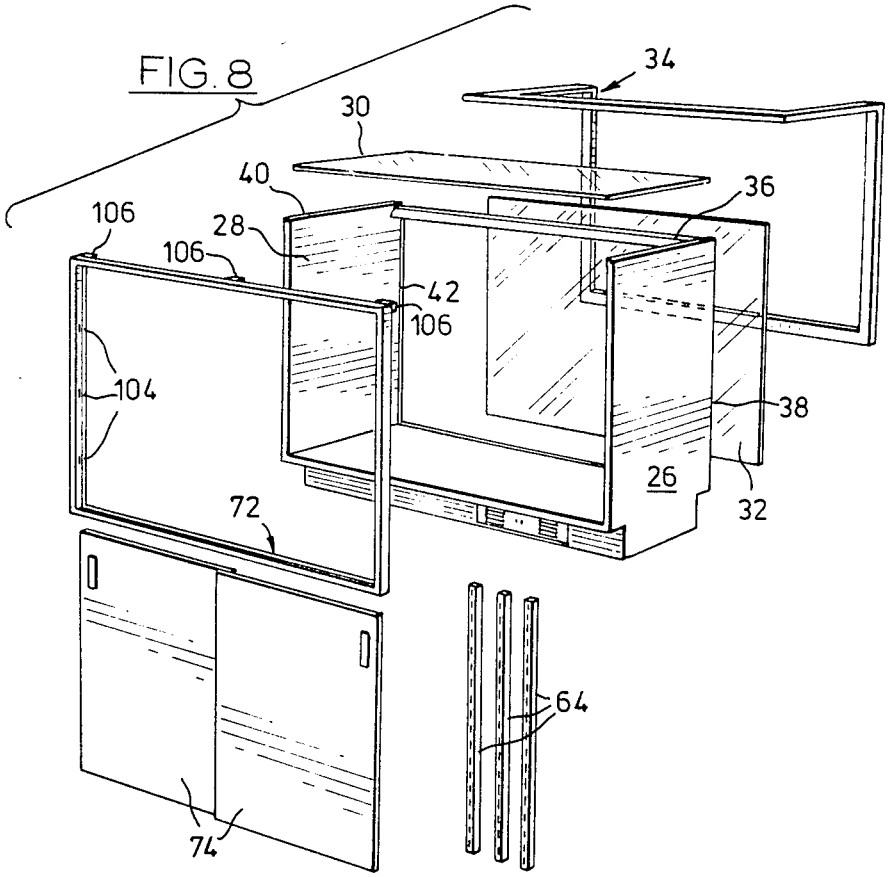
FIG. 8 is an exploded perspective view from the rear of the show case shown in FIG. 1.
Figure 9:
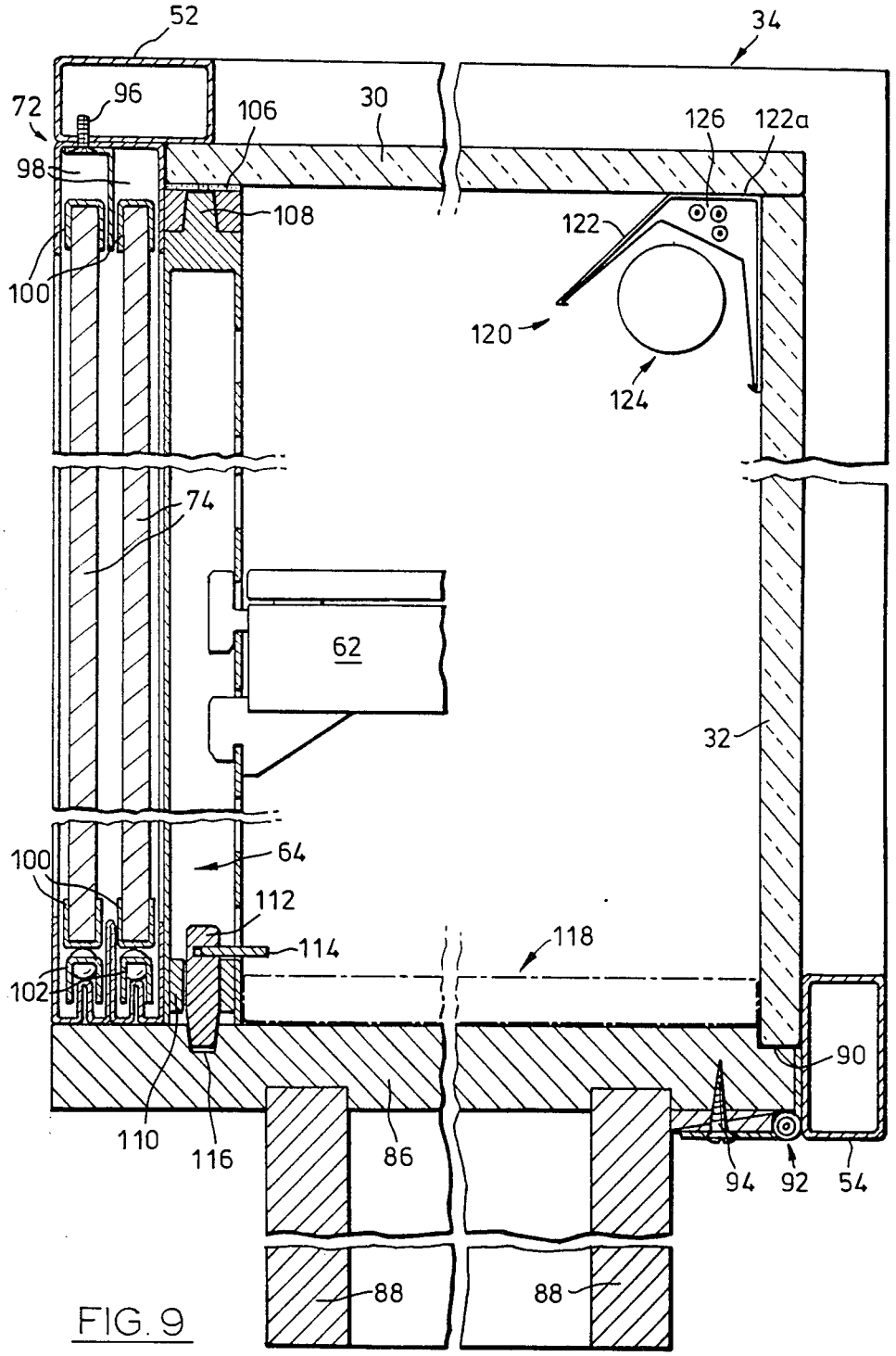
FIG. 9 is a vertical sectional view through the assembled show case of FIG. 8.

The structural features of the show case will now be described with reference to the remaining figures of the drawings. Reference will first be made to FIGS. 8 and 9. FIG. 8 is an exploded perspective view of the show case of FIG. 1 as seen from the rear while FIG. 9 is a vertical sectional view through the assembled show case of FIG. 8 as seen on a section line taken parallel to the end walls 26 and 28 at the center of the show case.

As mentioned previously, the carcass structure 22 of the show case is of wooden construction. FIG. 9 illustrates the fact that the base 24 comprises a wooden platform 86 supported on a pair of front and rear support members 88 which are glued into channels in the underside of the platform. As shown, these wooden members are plastic laminate faced. The end walls 26, 28 (FIG. 8) are also plastic laminate faced wooden members and are glued to the ends of the platform 86 and base members 88. In FIG. 8, the top edges 36, 40 and front edges 38, 42 of the respective endwalls are visible and it will be seen that these edges are in fact rebated to receive the marginal portions of the respective glass panels 30, 32. The front edge of platform 86 is also rebated as indicated at 90 (FIG. 9) to receive the lower edge of the front panel 32. The depth of each rebate corresponds substantially to the thickness of the glass panels 30, 32 so that the panels lie generally flush with the remaining lands adjacent the rebates. The panels are then trapped or sandwiched between the bottom surface of the rebates and the frame 34. FIG. 9 illustrates this feature quite graphically in the area of the rebate 90 and the bottom frame member 54. The frame holds the glass panels along each side margin of each panel and effectively conceals the relevant edges of the panel.

It can also be seen from FIG. 9 that the frame 34 itself is made of rectangular box section steel members welded together to form the one-piece configuration seen in FIG. 8. Two hinges, one of which is visible at 92 are welded to the bottom frame cross member 54 and secured to the underside of platform 86 by screws, one of which is indicated at 94. This allows the forward hinging of the frame discussed above. The top frame cross member 52 is held in place by two screws, one of which is visible at 96, inserted upwardly through the the back frame 72 and received in appropriately arranged screw-threaded openings in member 52. In the embodiment illustrated, the back frame 72 is designed to provide tracks 98 for the sliding doors 74 at the rear of the show case (see FIG. 6). The screws 96 are positioned within one of the door tracks and are effectively covered by the doors when the doors are closed. In an environment in which security is required, the doors will be provided with suitable locks (not shown) so that, when the doors are locked, access to the screws 96 will be virtuely impossible without breaking the doors or the locks. A further security feature is that the frame is secured at both top and bottom frame members in such a way that the securing method would not be readily apparent to a would-be thief in any event. At the same time, an authorized person wishing to open the show case, e.g. to change its display configuration or remove or replace one or more of the panels 30, 32 merely has to open the doors 74, remove two screws and hinge the frame forward as described previously.

The doors 74 are shown as wooden doors with a plastic laminate finish. Channels 100 are provided at the top and bottom edges of the doors for free sliding. At the bottom of the door, these channels run on ball bearings 102 suitably supported in channels in frame 72. It will be seen from FIG. 8 that the frame itself is of rectangular shape. The frame is secured in place by screws inserted horizontally through openings 104 in the vertical side members of the frame and screwed into the end walls of the carcass structure. Three brackets 106 project inwardly of the show case from the top member of frame 72 and serve as anchor points for the shelf standards 64 and supports for the top glass panel 32. Thus, referring back to FIG. 9, it will be seen that each bracket 106 has an opening which receives a pin 108 at the top of one of the brackets 64. For convenience of illustration, those pins are not shown in other views. At its lower end, the standard is fitted with an internal sleeve 110 which is tack welded inside the standard and which receives a vertically slidable pin 112. An arm 14 projects from pin 112 through one of the openings in standard 64 so that the pin can be lifted from externally of the standard. Pin 112 projects into a socket 116 in platform 86 by which the standard is retained in place when the pin is in its downwardly projecting position as shown. Obviously, each standard can easily be removed by simply lifting the pin 112 by way of arm 114 and then removing the standards bottom first.

The openings in the standard 64 are rectangular slots designed to receive conventional shelf supporting brackets (part of one of which is indicated at 62 in FIG. 9).

In FIG. 9, a pad 118 is shown between the lower end of standard 64 and the front glass panel 32. This pad is merely a conventional cushioned display pad and forms no part of the invention.

Also visible in FIGS. 8 and 9 (and in some of the earlier figures) is a light rail 120 which extends between the end walls 26, 28 of the carcass structure adjacent their outer front corners. The light rail comprises a metal shroud 122, the cross-sectional shape of which can best be seen in FIG. 9, and an inner light assembly 124 which is illustrated diagrammatically only. Wires for supplying power to the light are shown at 126. Shroud 122 is secured to the end walls 26, 28 at its ends and, in addition to serving its primary function, also helps to rigidify the carcass structure by maintaining the outer corners of the ends walls at exactly the required spacing. The shroud is shaped to define a right angular surface 122*a* at the junction between the two glass panels 30, 32 and the shroud is positioned so that the panels lie snugly in contact therewith at this position.

Figure 11:
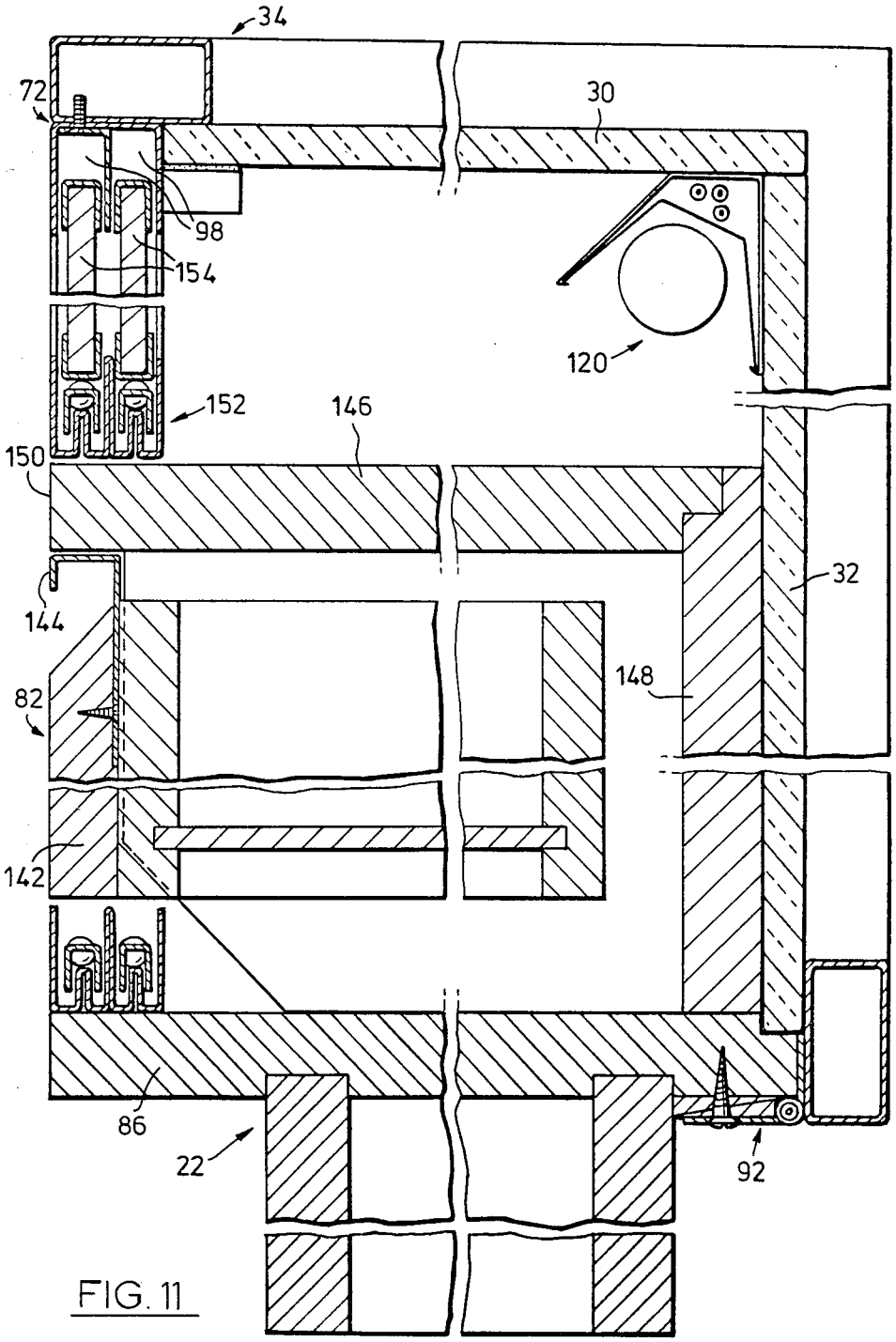
FIG. 11 is a view similar to FIG. 10 showing the internal configuration of FIG. 7.

FIGS. 10 and 11 are views generally similar to FIG. 9 but showing different internal display configurations within the show case. FIG. 10 shows generally the configuration of FIGS. 5 and 6 while FIG. 11 shows the configuration of FIG. 7. Otherwise, the remaining structure is the same as in FIG. 9 and will not be described again here.

FIG. 10 shows generally the two panels 68, 70 referred to previously in connection with FIG. 6 but also shows some further details. Thus, as discussed previously, the upper panel 68 is supported by adjustable brackets 76, one of which is visible in FIG. 10. The bracket is designed to slot into one of the standards 64 in conventional fashion but is provided at its outer end with an internally screw-threaded sleeve 128 which receives a levelling bolt 130. Bolt 130 has a pad 132 at its upper end which bears against a reinforcing panel 134 below panel 68. As shown in FIG. 6, three such brackets are provided and can be used to level panel 68 to accommodate any inaccuracies in the orientation of the standards 64.

FIG. 10 also shows the fact that a cushioned pad of conventional form is provided on the upper surface of panel 68, as indicated at 136. Each bracket 76 is provided with a spring steel member 138 which is riveted to the bracket itself and which includes limbs 140 arranged to bear against the rear edge of panel 68 and urge it firmly against the inner surface of the front glass panel 32. The purpose of these brackets is to attempt to eliminate dust from the inner surface of panel 32.

In FIG. 10, the panels 68, 70 and 134 are shown as being wooden panels with panel 70 having a plastic laminate facing on its outer surface. Of course, these materials are not essential. For example, panel 70 could be replaced by a mirror.

FIG. 11 shows some details of the drawer assembly 78 of FIG. 7. One of the drawers is shown at 82 and is again of wooden construction with a plastic faced outer panel 142 and a drawer handle 144 at the top of the panel. Top and front panels of enclosure 80 are shown at 146 and 148 and the front panel 148 has a plastic faced outer surface. Panel 146 also has a partial plastic coating as indicated at 150.

The drawer assembly is inserted into the show case through the frame 72 and is designed to in effect fit behind the frame. As such, in practice, it may be preferred to insert the drawer unit from the front of the show case after removing frame 34 and the front panel 32. In any event, the bottom track of frame 72 is unused in this configuration but the top track 98 co-operates with a similar track 152 at the top of panel 46 to receive doors 154 in similar fashion to the doors 74 described previously.

Figure 12:
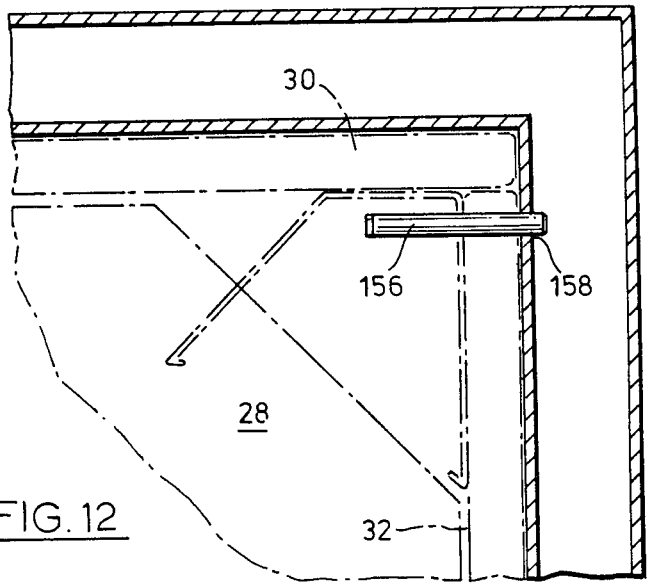
Figure 13:
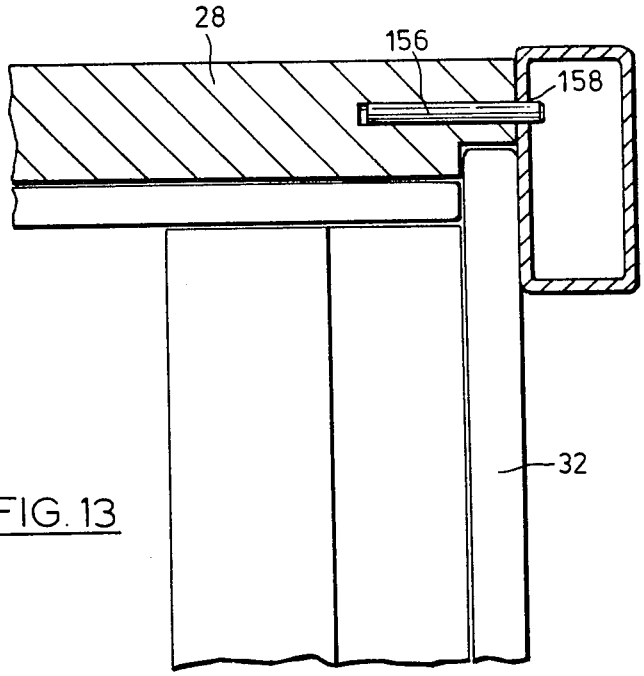

FIG. 12 is a detail view of the portion of FIG. 9 shown at the top right-hand corner and shows an alignment pin 156 which projects from the end wall 28 of the carcass structure forwardly into an opening 158 in frame 34. FIG. 13 is a vertical sectional view from above taken just above the pin 156 in FIG. 12 and shows the pin in position in the end wall. The outer end of the pin is tapered to provide a lead into the opening 158 when the frame is being "closed" (returned to the position shown in FIG. 1). The pin 156, and a corresponding pin (not shown) at the other side of the carcass structure locate the frame 34 laterally with respect to the carcass structure and accommodate any misalignment which might have occurred due to manufacturing inaccuracies or distortion of the show case components.

FIG. 14 shows further details of the same portion of the show case as FIG. 12 and illustrates specifically a bracket 160 at the end of the light rail 120. The bracket is welded to the shroud 122 of the light rail and secured by screws 162 to the end wall 28 of the carcass structure.

FIG. 15 is a horizontal sectional view from above corresponding to FIG. 14.

Figure 16:
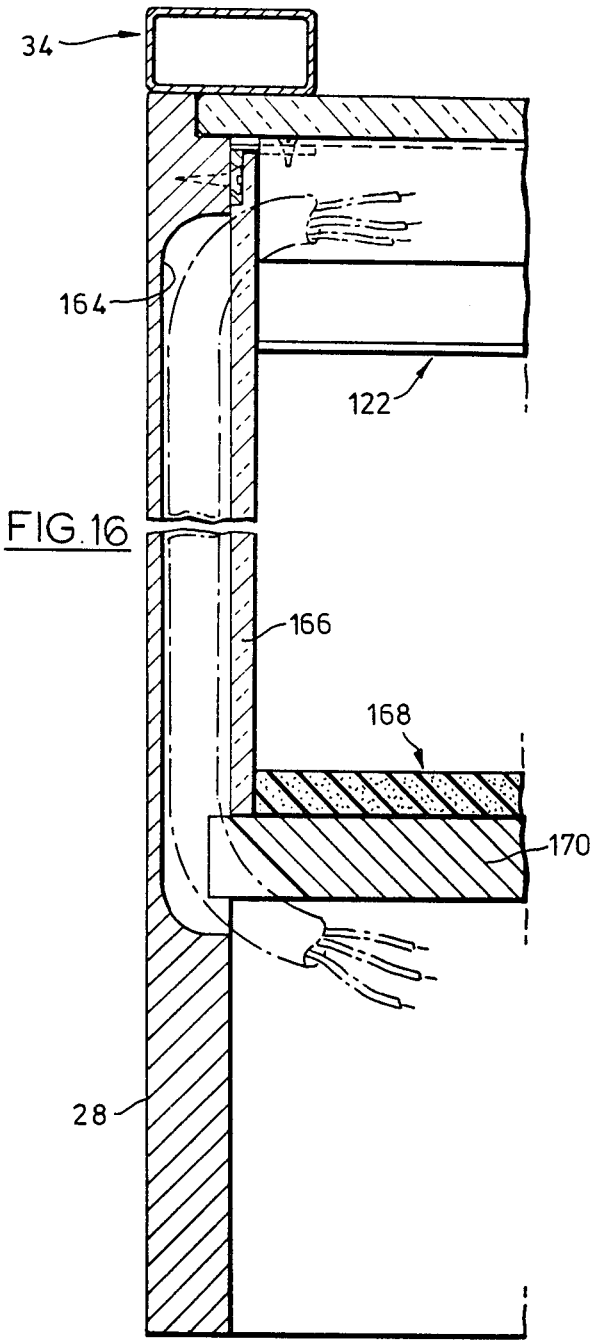

FIG. 14 shows a channel 164 formed in the inner surface of end wall 28 for receiving the electrical wiring 126 for the light rail. FIG. 16 also shows the channel 164 with the wiring 126 in place. In this embodiment, a mirror panel 166 is used to cover the channel 164 and is held in place between the relevant end edge of the shroud 122 and a cushioned display pad 168 on a shelf 170 in the show case. This configuration is specifically shown where the shelf 170 is at an intermediate height in the internal space within the show case but, of course, the same arrangement could of course be used to conceal wiring in other show case configurations.

Figure 17:
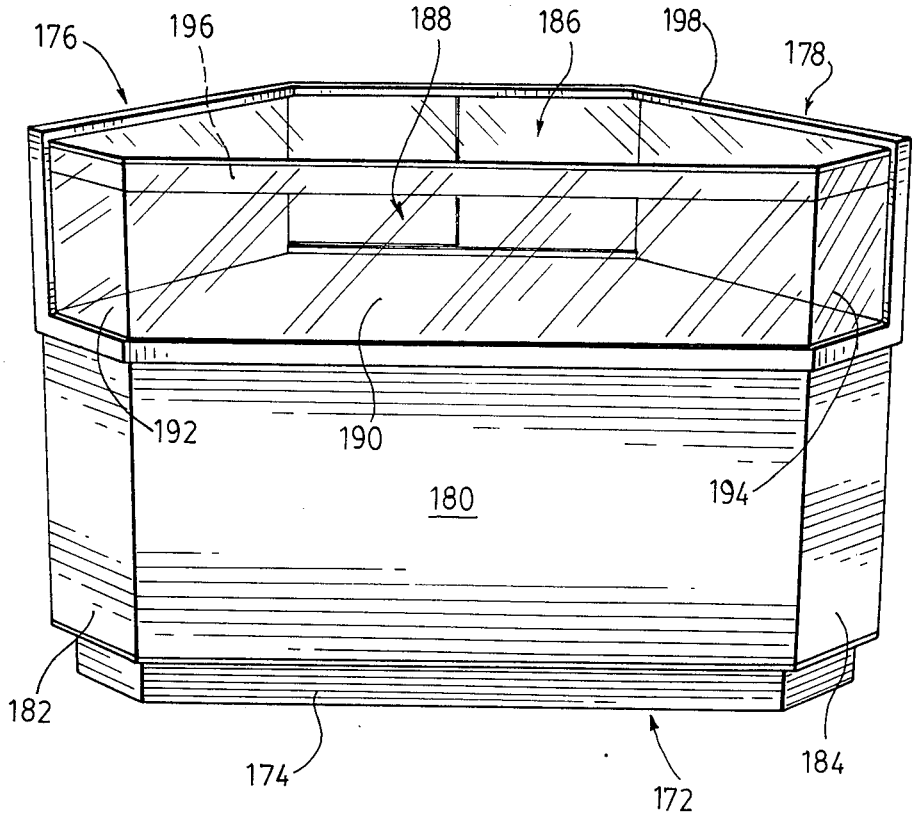

Finally, FIG. 17 illustrates the application of the invention to a show case having an overall shape which is other than generally rectangular; this view shows a corner style show case. The case has a carcass structure generaly denoted 172 including a base 174 and end walls, the locations of which are generally indicated at 176 and 178 which are outwardly angled with respect to one another. The carcass structure also includes a front wall 180 having at its ends wall portions 182 and 184 which are angled rearwardly to the end walls 176 and 178. The show case has a top glass panel 186 which is shaped to conform with the configuration of the walls of the carcass structure and a front panel 188 made up of a central panel 190 and end panel portions 192 and 194 which are sealed to the central panel by a silicone sealant. A light rail is visible behind these panels at 196.

In this case, the frame of the show case is denoted 198 and includes frame members shaped to overlie the outer marginal edges of the glass panels as shown. The frame is secured to the carcass structure by screws (not visible) at the positions of the top and bottom cross frame members respectively generally as shown in connection with FIG. 9 in the case of the top frame member and as described below with reference to FIG. 9 in the case of the bottom frame member.

It will be appreciated that the preceding description relates to particular preferred embodiments of the invention only and that, while some alternatives and changes in configuration have been indicated, other modifications are possible within the broad scope of the invention. For example, while the frame 34 has been shown hinged to the carcass structure of the show case, this is not essential. In one alternative embodiment, the frame could be secured in place solely by screws. Referring to FIG. 9 by way of example, the hinge 92 would then be replaced by a fixed lug welded to the frame and held in place on the carcass structure by a screw or bolt; where security is a concern, the bolt will receive a nut received in a recess formed in the upper surface of platform 86. Other alternatives would be to replace the hinges on the bottom frame member by pin and socket coupling arrangements (e.g. depending pins on the frame for engagement in sockets on the carcass structure so that the frame could be in effect lifted off the carcass and removed completely after releasing the top frame member). It would also be possible to make the frame in more than one part. For example, separate generally L-shaped frames could be used one at each side of the show case. In all cases, associated structures such as counters can be provided outwardly of and may incorporate the end walls of the carcass structure.

I claim:

1. A show case comprising:

a carcass structure which includes a base and end walls extending generally vertically upwards from the base and defining with the base a space for receiving merchandise to be displayed, the end walls having respective top and front edges against which can be positioned respective top and front panels extending between the end walls, for enclosing merchandise in said space;

panel retaining frame means comprising a unitary frame including frame members arranged to overlie said edges of the end walls and trap against said edges, intervening portions of said panels so that the panels are held in place on the carcass structure by said frame means, and top and bottom cross frame members at which said frame is removably secured to the carcass structure; and, means removably securing the frame means to the carcass structure, comprising hinge means coupling said bottom cross frame member to said structure and at least one retaining element for releasably securing said top frame member to said structure;

the show case having a back which is at least initially open and including a peripheral frame defining said back and including top and bottom frame members, said frame being secured to said end walls of the carcass structure, and wherein said retaining element for said panel retaining frame comprises at least one screw extending upwardly through said top frame member and into said top cross member of the panel retaining frame means, whereby said retaining screw is accessible at the rear side of the show case only.

2. A show case as claimed in claim 1, wherein said top and bottom frame members define tracks receiving sliding doors adapted to close the back of the show case, and wherein said at least one screw extends upwardly through the track of the upper frame member and is concealed in a closed position of said doors.

3. A show case comprising:

a carcass structure which includes a base and end walls extending generally vertically upwards from the base and defining with the base a space for receiving merchandise to be displayed, the end walls having respective top and front edges against which can be positioned respective top and front panels extending between the end walls, for enclosing merchandise in said space;

frame means including frame members arranged to overlie said edges of the end walls and trap against said edges, intervening portions of said panels so that the panels are held in place on the carcass structure by said frame means;

means removably securing the frame means to the carcass structure;

the show case having a back which is at least initially open and further comprising a plurality of shelf support standards removably disposed in generally vertical positions adjacent the back of the show case and adapted to receive shelf supporting brackets;

said front panel extending over substantially the entire height of the front of the show case and the show case further comprising a shelf supported by said shelf brackets above said base and extending to the inner surface of said front panel, and an inner panel extending downwardly from said shelf in contact with the inner surface of said front panel over substantially the entire width thereof; said shelf and inner panel having co-operating rebates in adjacent edges thereof;

the show case further comprising spring means on said brackets arranged to urge said shelf and, with it, said inner panel against the inner surface of the front panel.

4. A show case as claimed in claim 3, wherein said frame means comprises a unitary frame including said frame members and top and bottom cross frame members at which said frame is removably secured to the carcass structure.

5. A show case as claimed in claim 4, wherein said top cross frame member extends along a rear edge of said top panel and said bottom frame member extends along a bottom edge of said front panel.

6. A show case comprising:

a carcass structure which includes a base and end walls extending generally vertically upwards from the base and defining with the base a space for receiving merchandise to be displayed, the end walls having respective top and front edges;

respective top and front panels extending between said end walls for enclosing merchandise in said space, said panels being supported on said top and front edges of the carcass structure end walls;

frame means in the form of a unitary frame comprising first and second frame members overlying the respective top edges of the carcass end walls, third and fourth frame members overlying the respective front edges of said end walls, a top cross member extending between the first and second frame members along a rear edge of said top panel, and a bottom cross member extending between said third and fourth frame members along a bottom edge of said front panel, whereby said first, second, third and fourth frame members trap said panels against the top and front edges of the carcass end walls so that the panels are held in place on the carcass structure by said frame means; and, means removably securing the frame means to the carcass structure.

7. A show case as claimed in claim 6, wherein said means removably securing the frame means to the carcass structure comprise hinge means coupling said bottom cross frame member to said structure and at least one retaining element for releasably securing said top frame member to said structure.

8. A show case as claimed in claim 6, wherein said frame comprises a welded assembly of box section metal members decoratively finished to provide a visual design feature of said show case.

9. A show case as claimed in claim 6, wherein said top and front edges of the end walls of the carcass structure against which the panels are positioned are defined by rebates formed in said end walls for locating the panels with respect to said walls.

10. A show case as claimed in claim 6, wherein said front panel extends over a part only of the vertical height of the front of the show case.

11. A show case as claimed in claim 3, having a back which is at least initially open and including a peripheral frame defining said back and including top and bottom frame members, said frame being secured to said end walls of the carcass structure, and wherein said retaining element for said panel retaining frame comprises at least one screw extending upwardly through said top frame member and into said top cross member of the panel retaining frame, whereby said retaining screw is accessible at the rear side of the show case only.

12. A show case as claimed in claim 6, having a back which is at least initially open and further comprising a plurality of shelf support standards removably disposed in generally vertical positions adjacent the back of the show case and adapted to receive shelf supporting brackets.

13. A show case as claimed in claim 12, wherein said front panel extends over substantially the entire height of the front of the show case and wherein the show case further comprises a shelf supported by said shelf brackets above said base and extending to the inner surface of said front panel, and an inner panel extending downwardly from said shelf in contact with the inner surface of said front panel over substantially the entire width thereof.

14. A show case as claimed in claim 13, wherein said shelf and inner panel have co-operating rebates in adjacent edges thereof, and wherein the show case further comprises spring means on said brackets arranged to urge said shelf and, with it, said inner panel against the inner surface of the front panel.

15. A show case as claimed in claim 6, having a back which is initially open, and further comprising a drawer assembly received in said space within the show case and defining a merchandise supporting surface within said space, said assembly including at least one drawer accessible at said back of the show case.

16. A show case as claimed in claim 6, further comprising a light rail comprising a light assembly and a shroud enclosing and supporting said assembly, said shroud extending between said end walls of the carcass structure and being coupled to said walls.

* * * * *